US008579627B2

(12) United States Patent
Zanella

(10) Patent No.: US 8,579,627 B2
(45) Date of Patent: Nov. 12, 2013

(54) METHOD AND A DEVICE FOR CONTROLLING THE FEED OF A COMBUSTIBLE GAS TO A BURNER APPARATUS

(75) Inventor: Stefano Zanella, Montebelluna (IT)

(73) Assignee: Sit la Precisa S.p.A. con Socio Unico, Padua (IT)

( * ) Notice: Subject to any disclaimer, the term of this patent is extended or adjusted under 35 U.S.C. 154(b) by 507 days.

(21) Appl. No.: 12/921,836

(22) PCT Filed: Mar. 4, 2009

(86) PCT No.: PCT/EP2009/052550

§ 371 (c)(1),
(2), (4) Date: Sep. 10, 2010

(87) PCT Pub. No.: WO2009/115411

PCT Pub. Date: Sep. 24, 2009

(65) Prior Publication Data

US 2011/0003260 A1 Jan. 6, 2011

(30) Foreign Application Priority Data

Mar. 19, 2008 (IT) ..... PD2008A0088

(51) Int. Cl.
*F23N 1/00* (2006.01)
*F23N 5/00* (2006.01)

(52) U.S. Cl.
USPC ..... 431/12; 431/38; 137/501

(58) Field of Classification Search
USPC ..... 431/38, 12; 137/501; 251/30.01, 30.02, 251/50, 51
See application file for complete search history.

(56) References Cited

U.S. PATENT DOCUMENTS 3,905,652 A * 9/1975 Sugiyama et al. ..... 303/166
4,802,507 A 2/1989 Wilson
2006/0292505 A1* 12/2006 Giacomelli ..... 431/12

FOREIGN PATENT DOCUMENTS

JP 62073010 A 4/1987
WO 2005024302 A1 3/2005
WO WO 2007/060696 * 5/2007 ..... F23K 5/00

* cited by examiner

*Primary Examiner* — Kenneth Rinehart
*Assistant Examiner* — Tiffany Johnson
(74) *Attorney, Agent, or Firm* — Volpe And Koenig, P.C.

(57) ABSTRACT

A method is provided for controlling the feed of a combustible gas by a valve device placed in a feed pipe which has a gas inlet section and a gas outlet section. The device includes a valve seat in the pipe associated with a membrane-operated plug and a device for returning the plug to a position in which the valve seat is shut off. The method includes the steps of creating a pressure difference in a section of the pipe downstream of the plug with respect to the direction of flow, by a constriction in the pipe having a predetermined cross section, the pressure difference being defined by a first pressure upstream of the constriction and a second pressure downstream of the constriction; collecting the signal formed by the second pressure downstream of the constriction and making the second pressure act on the side of the membrane opposite that on which the first pressure acts; and generating a regulatable load on the membrane of the membrane operating system.

4 Claims, 2 Drawing Sheets

METHOD AND A DEVICE FOR CONTROLLING THE FEED OF A COMBUSTIBLE GAS TO A BURNER APPARATUS

TECHNICAL FIELD

The present invention relates to a method for controlling the feed of a combustible gas to a burner apparatus, according to the features stated in the preamble of claim 1 which is the principal claim. The invention also relates to a valve device operating by the aforesaid method.

TECHNOLOGICAL BACKGROUND

The invention is particularly, but not exclusively, applicable to the field of valve devices designed to feed a flow of gas which can be regulated in a particularly accurate and precise way, where there is a requirement to provide rather extensive modulation of the range of feed flow rates. An example of a typical application of this type is a heat and power generating system based on the use of fuel cells. In these systems, heat is generated by processes of combustion of combustible mixtures, and the gas is also converted directly to electrical energy by electrochemical processes in the fuel cells. In these processes, the flow rate of the combustible gas (such as natural or liquid gas) has to be regulated accurately, especially at the minimum flow rates required in the desired modulation range. Known solutions provide for the use of gas feed lines of the "open circuit" type, in which the feed flow rate is directly correlated with the inlet pressure of the gas from the gas supply mains. However, this gas inlet pressure is difficult to keep under control, since it is subject to fluctuations caused by conditions in the mains. Consequently, the supply system along the line becomes unstable and inaccurate, especially at pressures close to the minimum feed pressure (and flow rate).

Moreover, the outlet pressure can also be subject to fluctuations which are difficult to control. For example, if the outlet cross section is made to communicate with the restricted section of a Venturi tube, provided to mix the gas fed by the valve with air or other air-like substances, the feed pressure of the valve device may be subject to fluctuations which can have a significant effect on the feed flow rate.

DESCRIPTION OF THE INVENTION

The fundamental problem of the present invention is that of providing a method and a device whose structural and functional design is such that the limitations of the aforementioned prior art can be overcome.

This problem is resolved by the invention by means of a method of controlling the feed of a combustible gas, according to the claims below, and by means of a valve device operating by this method.

BRIEF DESCRIPTION OF THE DRAWINGS

Other features and advantages of the invention will become clear from the following detailed description of a preferred example of embodiment thereof, illustrated, for the purpose of illustration and in a non-limiting way, in the attached drawings, in which.

PREFERRED EMBODIMENTS OF THE INVENTION

Figure 1:
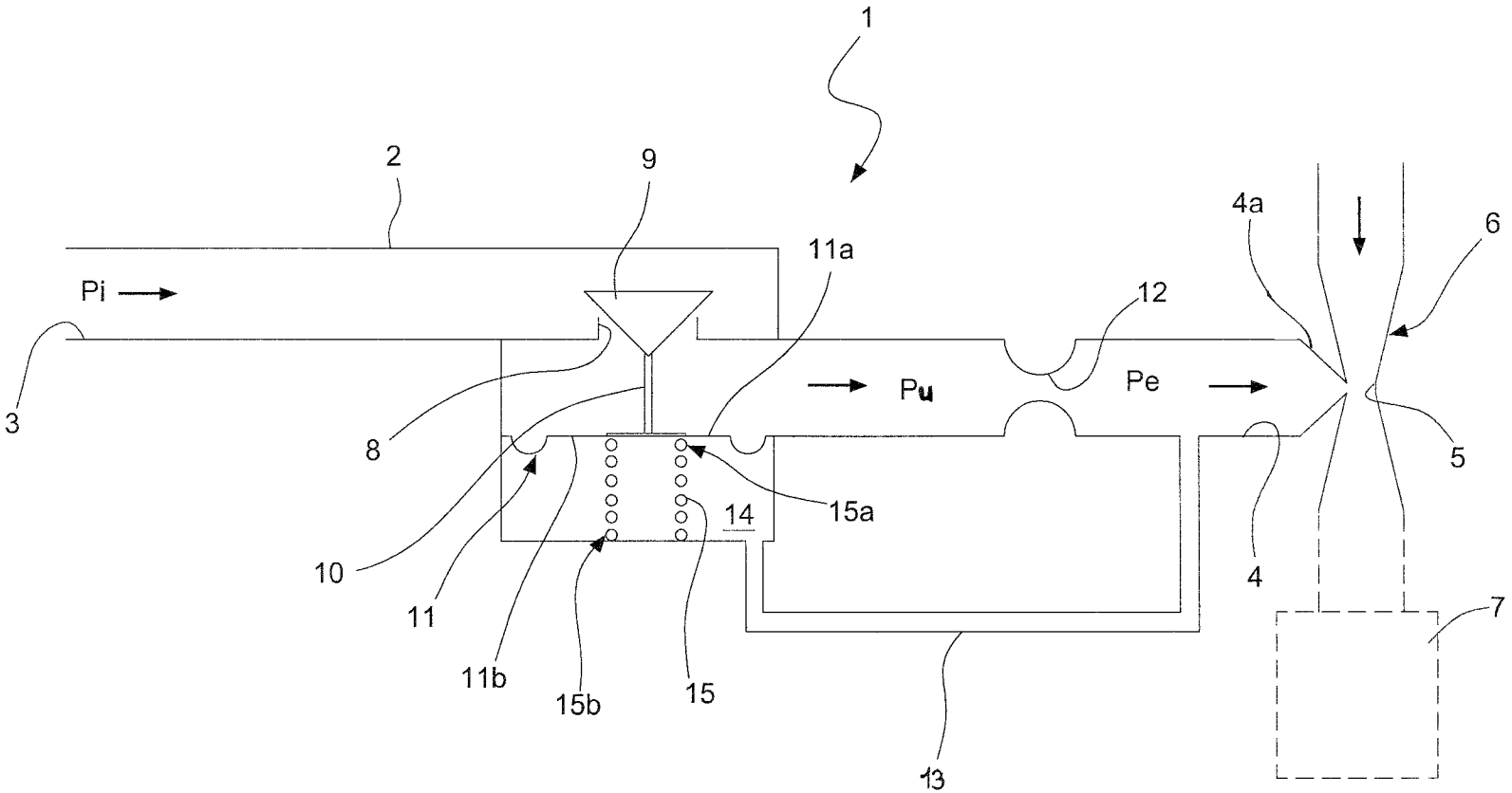
FIG. 1 is a schematic view, in longitudinal section, of a first example of a valve device operating according to the method of the invention.

With initial reference to FIG. 1, the number 1 indicates the whole of a valve device for controlling the feed of a combustible gas (referred to below simply as "gas"), made according to the present invention.

The device comprises a feed passage 2 for conveying the gas from a feed element to a burner apparatus (neither of which is shown), this passage extending between a gas inlet section 3 and a gas outlet section 4. At the outlet 4, the passage has a narrowed cross section, for example in the form of a nozzle 4*a*. In a preferred application, the nozzle 4*a* is made to be connected to the restricted cross section 5 of a Venturi tube system 6 along which a flow of an air-like medium, for example vapour, is provided, in order to mix these fluids and create a suitable mixture for supplying a fuel cell unit 7, only shown schematically, in which electrical energy is generated directly by an electrochemical process. This system can be integrated into heating apparatus such as boilers, including those for domestic use, which have combined systems for producing heat by conventional gas combustion processes and for producing electrical energy by electrochemical processes of the aforementioned type.

In the pipe 2 there is formed a valve seat 8, interacting with a plug 9 whose operating rod 10 is connected rigidly to a membrane 11 for operating the valve. Downstream of the valve 8 with respect to the direction of flow, the pipe 2 has a constriction 12 or other similar narrowing of the cross section of the pipe, with a predetermined width, such that a pressure drop is created across the constriction. Pu indicates the pressure upstream of the constriction, corresponding to the pressure downstream of the plug 9. Pe indicates the pressure downstream of the constriction 12, the pressure difference across the constriction, indicated by Dp, being equal to Pu—Pe. Additionally, Pi indicates the pressure of the gas at the inlet of the pipe 2, which depends on the mains supply conditions.

One side of the membrane 11, indicated by 11*a*, is also subjected to the pressure Pu downstream of the plug 9, while the other side, indicated by 11*b*, is subjected to the pressure Pe, the signal formed by this pressure being communicated through a connecting pipe 13 extending between a section of the pipe 2 downstream of the constriction (in the region between the constriction and the nozzle) and a chamber 14 which is partly delimited by the membrane 11, as clearly shown in FIG. 1.

The side 11*b* of the membrane is also subjected to an resilient load F created by a spring 15, whose opposite axial ends 15*a* and 15*b* are connected, respectively, to the membrane 11 and to a fixed wall 14*a* of the chamber 14.

The valve device described above can also comprise means for returning the plug 9 to the condition in which the valve seat 8 is closed, for example resilient means such as a spring (not shown in FIG. 1).

In operation, the method of controlling the gas feed according to the invention requires the selection of a predetermined width of the constriction 12, which creates a corresponding pressure difference Dp across the constriction. Since the pressures Pu and Pe are made to act on the opposite sides of the membrane 11, the balance of forces on the operating membrane 10 causes the difference Dp to be substantially dependent, in a proportional way, on the load F (if S denotes the surface area of the membrane 10, then Dp=F/S). Consequently, since the flow rate Q of gas fed to the outlet section 4 is known to vary as a function of the square root of the difference Dp, the feed flow rate Q, which is regulated by adjusting the resilient load F, can advantageously be controlled independently of the absolute pressure levels present in the inlet section (Pi) and in the outlet section (Pu) of the pipe 2. Since, in particular, the inlet pressure Pi, determined by the mains supply conditions, may be subject to fluctuations which may be significant and not easily controllable, the method enables the flow rate Q to be regulated accurately and independently of the pressure Pi.

Figure 2:
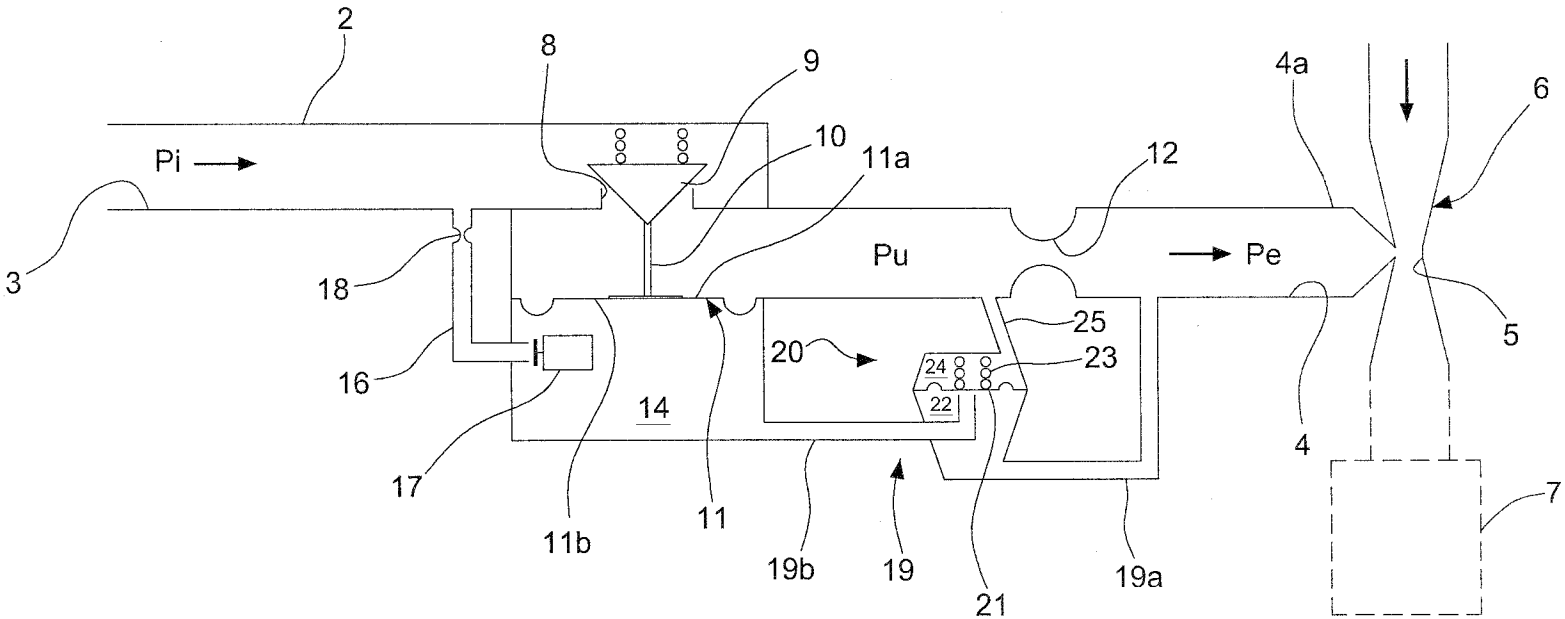
FIG. 2 is a schematic view, in longitudinal section, of a second example of a device and method according to the invention.

FIG. 2 shows a second example of a valve device operating according to the method of the invention, in which elements similar to those of the previous example are identified by the same reference numerals.

This example differs from that described above in that the valve device is made in the form of a servo valve, and a control circuit branched from the pipe 2 is provided for the servo-assisted operation of the main valve (the plug 9).

The side 11*b* of the membrane delimits a control chamber 14 which communicates with the main pipe 2, upstream of the valve seat 8, through a control pipe 16. The section of the pipe 16 which connects this pipe to the chamber 14 is selectively opened or closed by the plug of a solenoid valve 17, designed for the servo-assisted operation of the main valve 8.

The number 18 indicates a constriction in the pipe 16.

The control chamber 14 is connected to the outlet section 4 of the pipe 2, downstream of the constriction 12, through a discharge pipe 19 on which a pressure regulator device, indicated as a whole by 20, is provided. This is a membrane-type pressure regulator 21, of a conventional type, in which one side of a membrane delimits a control chamber 22 which communicates, through part 19*a* of the pipe 19, with the outlet section 4, and which can also shut off the outlet section of the other part 19*b* of the pipe 19 communicating with the control chamber 14. The opposite side of the membrane is biased by a calibration spring 23 housed in a chamber 24, which is connected through a pipe 25 to a section of the pipe 2 upstream of the constriction 12. The regulator 20 is designed to react to the variations in the feed pressure and to compensate for these, and also to return the pressure to a calibrated value predetermined by regulating the load F' of the spring 23.

In operation, the opening and closing of the main valve seat 8 is controlled by means of the servo-assistance circuit operated by the solenoid valve 17.

In a similar way to the previous example, the method of controlling the gas feed according to the invention requires the selection of a predetermined width of the constriction 12, which creates a corresponding pressure difference Dp across the constriction. Since the pressures Pu and Pe are made to act on the opposite sides of the membrane 21, the balance of forces on the operating membrane 21 causes the difference Dp to be substantially dependent, in a proportional way, on the load F' (if S' denotes the surface area of the membrane 21, then Dp=F'/S'). Consequently, since the flow rate Q of gas fed to the outlet section 4 is known to vary as a function of the square root of the difference Dp, the feed flow rate Q, which is regulated by adjusting the resilient load F', can advantageously be controlled independently of the absolute pressure levels present in the inlet section (Pi) and in the outlet section (Pu) of the pipe 2. It should also be noted that, in both of the examples described above, provision can be made to modulate the load F, F' applied to the corresponding membranes over a predetermined modulation range, by using actuators which act on the membrane itself. Examples of such actuators are electromagnetic actuators having movable magnetic operating rods, or motors which can impart a controlled translational movement to actuator rods acting on the membrane. In all these applications, the modulation of the load F, F' can be used to modulate the feed flow rate with predetermined modulation ranges defined between specified minimum and maximum flow rates (and hence minimum and maximum pressures).

Thus the invention resolves the initial problem and achieves its objects while having the stated advantages over the known solutions.

In particular, it should be noted that, by using the method and the device according to the invention, the feed flow rate is controlled in such a way that it is substantially a function of the pressure difference across the predetermined constriction.

The invention claimed is:

1. A method of controlling the feed of a combustible gas by a valve device placed in a feed pipe which has a gas inlet section and a gas outlet section, the device comprising a valve seat in said pipe associated with a membrane-operated plug and a device for returning the plug to a position in which the valve seat is shut off, the method comprising:

creating a pressure difference in a section of the pipe downstream of said plug with respect to the direction of flow, by a constriction in the pipe having a predetermined cross section, said pressure difference being defined by a first pressure upstream of the constriction and a second pressure downstream of said constriction, collecting the signal formed by said second pressure downstream of said constriction and making said second pressure act on the side of the membrane opposite that on which the first pressure acts, generating a regulatable load on the membrane of a membrane operating system, this load being independent of said first and second pressures, such that the pressure difference can be regulated by regulating said load acting on the membrane, said load being correlated proportionally with said difference, in such a way that flow rate of the gas fed to the outlet section, which is a function of said pressure difference, is controlled independently of the pressure levels present in the inlet section and in the outlet section of said pipe; and wherein said valve device is made in the form of a servo valve, the method including the following steps:

collecting the signals formed by said first and second pressures across the constriction, by corresponding pipes, and bringing said pressures to opposite sides of a second membrane of a pressure regulator fitted in a control circuit of the servo valve, and generating said regulatable load on said second membrane of the pressure regulator only, independently of said first and second pressures, in such a way that the pressure difference can be regulated by regulating the load acting on said second membrane, the load being correlated proportionally with said pressure difference, in such a way that the flow rate of the gas fed to the outlet section, which is a function of said pressure difference, is controlled independently of the absolute pressure levels present in the inlet section and in the outlet section of said pipe.

2. A method according to claim 1, in which a signal formed by a control pressure of the servo circuit is collected in a section of the pipe upstream of the valve seat, said signal is carried to a control chamber delimited at least partly by the operating membrane associated with said valve seat, and said control chamber is made to communicate with the pressure regulator, to bring the control pressure to the side of the membrane of said regulator associated with said second pressure.

3. A method according to claim 2, in which said generated load associated with the corresponding membrane is modulated in such a way that the pressure difference and the feed flow rate in the outlet section can be modulated in proportional correlation with the variation of the load.

4. A valve device for controlling the feed of a combustible gas, comprising:

a main gas feed pipe which has an inlet section and an outlet section, a valve seat provided in said pipe and associated with a membrane-operated plug and a device for returning the plug to a position in which the valve seat is shut off, a constriction in said pipe having a predetermined cross section, downstream of the plug with respect to the direction of the flow, such that a pressure difference is created across said constriction, this difference being defined by a first pressure upstream of the constriction and a second pressure downstream thereof, a second pipe for connecting a section of the main pipe downstream of the constriction to a chamber delimited by said membrane, such that the second pressure is made to act on the side of the membrane of said chamber opposite the side on which said first pressure acts, a device for generating a regulatable load on the membrane of a membrane operating system, such that the pressure difference can be regulated by regulating said load and is correlated proportionally with said load, in order to feed gas to the outlet section at a flow rate which is a function of said difference and which is controlled independently of the pressure levels present in the inlet section and in the outlet section of said pipe; and the valve device made in the form of a servo valve and comprising a control circuit of said servo valve and a membrane-type pressure regulator provided in the control circuit, pipes being provided to bring said first and second pressures, present upstream and downstream of the constriction, to respective sides of the membrane of said regulator, said device for generating a load acting solely on the membrane of said regulator, such that the pressure difference is controlled by regulating the load acting on the membrane of the pressure regulator, in order to provide a feed flow rate in said outlet section which is a function of said pressure difference and which is controlled independently of the individual pressure levels present in the inlet section and in the outlet section of the main pipe.

* * * * *